US012588787B1

(12) United States Patent
Alexander et al.

(10) Patent No.: US 12,588,787 B1
(45) Date of Patent: Mar. 31, 2026

(54) BATH TOOL

(71) Applicant: Alon Alexander, Valley Village, CA (US)

(72) Inventors: Alon Alexander, Valley Village, CA (US); Chun Wang, Valley Village, CA (US)

( * ) Notice: Subject to any disclaimer, the term of this patent is extended or adjusted under 35 U.S.C. 154(b) by 0 days.

(21) Appl. No.: 18/768,008

(22) Filed: Jul. 10, 2024

(51) Int. Cl.
*A47K 7/02* (2006.01)

(52) U.S. Cl.
CPC ..... *A47K 7/028* (2013.01)

(58) Field of Classification Search
CPC ..... A47K 7/028; A47K 7/02; A47K 7/022; A47K 7/026; A47K 7/06
See application file for complete search history.

(56) References Cited

U.S. PATENT DOCUMENTS

| | | | | |
|---|---|---|---|---|
| 7,386,912 | B2 * | 6/2008 | Horton | A46B 5/002 15/164 |
| D714,557 | S * | 10/2014 | Gonzalez | D4/131 |
| 11,779,966 | B1 * | 10/2023 | Bordy | B08B 1/12 15/56 |
| 2018/0186344 | A1 * | 7/2018 | Voelker | A46B 5/0016 |
| 2020/0281344 | A1 * | 9/2020 | Agha | A46B 9/005 |

FOREIGN PATENT DOCUMENTS

CN 216753805 U * 6/2022

* cited by examiner

*Primary Examiner* — Shay Karls
(74) *Attorney, Agent, or Firm* — Michael D. Eisenberg

(57) ABSTRACT

An improved bath tool for cleaning a person's body. The bath tool incudes a handle, a frame, and cleaning elements. The frame is connected to one end of the handle. The cleaning elements disposed on both of the frame.

19 Claims, 13 Drawing Sheets

100

100

BATH TOOL

TECHNICAL FIELD

This invention relates to cleaning devices, and more specifically to device for cleaning a person's body, particularly, but not limited to, in a bath or shower.

BACKGROUND OF THE INVENTION

Personal hygiene involves those practices performed by a person to care for their bodily health and well-being through cleanliness. Motivations for personal hygiene practice include reduction of personal illness, healing from illness, optimal health and sense of wellbeing, social acceptance, and prevention of spread of illness to others.

Bathing and showering are some of the practices that are part of personal hygiene. During a bath or shower, a person scrubs the person's body to remove accumulated dirt. Often the person uses a cleaning element, such as brush, sponge, or loofah for scrubbing the skin more efficiently.

BRIEF SUMMARY OF EMBODIMENTS OF THE INVENTION

The inventors have found that scrubbing a person's skin may require effort and at times spots may be missed. An aim of the present invention is to provide a bath tool that makes it easier for a person to reach and scrub the person's skin in a bath or shower.

Therefore, an aspect of some embodiments of the present invention relates to an improved bath tool for cleaning a person's body, comprising: a handle; a frame for holding cleaning elements, the frame being shaped as an open or closed loop; cleaning elements disposed on the frame.

In a variant, the handle comprises a rod having a grip end and a frame end, the frame end being joined to the frame.

In another variant, the handle comprises a hand grip and a rod, the rod having a grip end and a frame end, the grip end being joined to the hand grip and the frame end being joined to the frame.

The cleaning elements may include brush bristles.

The cleaning elements may include one or more sponges.

The cleaning elements may include natural and/or synthetic loofahs.

In yet another variant, the cleaning elements form a first cleaning surface on an inner surface of the frame.

The cleaning elements may further form a second cleaning surface on an outer surface of the frame.

In a further variant, the cleaning elements may cover a surface of the frame.

In some embodiments of the present invention, the frame comprises first and second arms connected to one end of the handle, joined to a same end of the handle, and the arms being biased toward each other.

In a variant, the arms are flexible.

In another variant, the cleaning elements on the first arm form a first cleaning surface facing the second arm, while the cleaning elements on the second arm form a second cleaning surface facing the first arm.

In yet another variant, the cleaning elements on the first arm further form a third cleaning surface facing away from the second arm, while the cleaning elements on the second arm further form a fourth cleaning surface facing away from the first arm.

In a further variant, the cleaning elements on the first arm surround the first arm, while the cleaning elements on the second arm surround the second arm.

In a variant, the arms together form a U-shape.

In a variant, the arms are integral with each other.

In a variant, the frame is hingedly joined to the handle.

The bath tool may include a locking mechanism configured to be removably lock the frame at a desired angle with the respect to the handle.

In another aspect of some embodiments of the present invention, an improved bath tool for cleaning a person's body is provided, comprising: a handle; and a frame for holding cleaning elements, the frame being shaped as an open or closed loop. The frame is configured to have cleaning elements joined thereto.

In yet another aspect of some embodiments of the present invention an add-on to a rod is provided. The add-on is configured to form an improved bath tool for cleaning a person's body. The add-on includes a sleeve and a frame. The sleeve Is configured to fit onto an end segment of a rod. The frame is configured for holding cleaning elements, the frame being shaped as an open or closed loop. The frame is configured to have cleaning elements joined thereto.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1A:
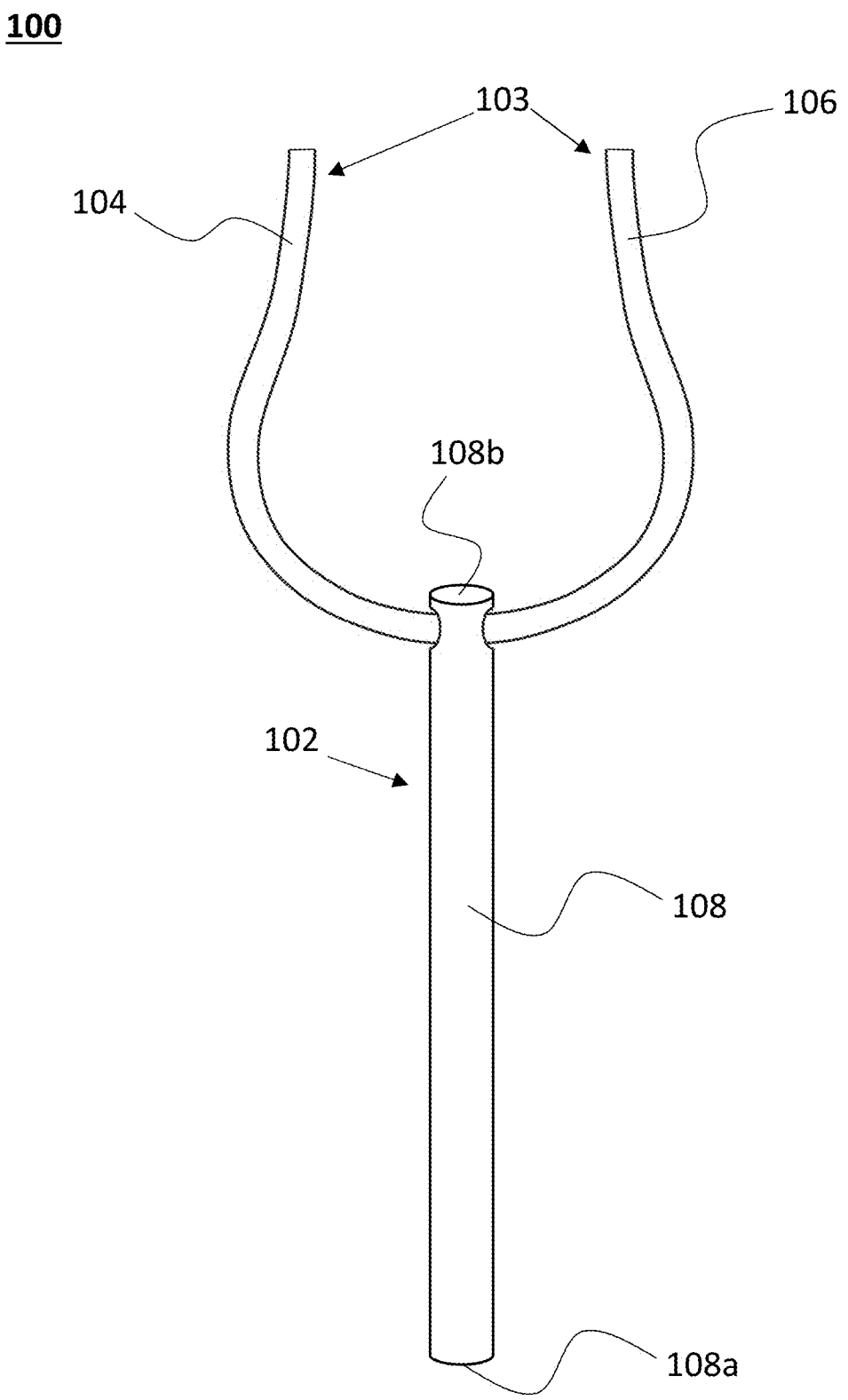
FIG. 1*a* illustrates an improved bath tool for cleaning a person's body with a handle in the form of a rod, according to some embodiments of the present invention.

FIG. 1*a* illustrates an improved bath tool 100 for cleaning a person's body with a handle in the form of a rod, according to some embodiments of the present invention. FIG. 1 illustrates an improved bath tool for cleaning a person's body with a handle which includes a rod and a hand grip, according to some embodiments of the present invention. FIG. 1 illustrates an improved bath tool for cleaning a person's body with a handle which includes a hand grip, according to some embodiments of the present invention.

The improved bath tool 100 is usable for cleaning a person's body. The bath tool includes a handle 102, and a frame 103 a frame for holding cleaning elements, the frame being shaped as an open or closed loop. The handle and the frame may be made of any material. Nonlimiting examples of material includes plastics, silicone, or aluminum. Any other material may be used.

Figure 1B:
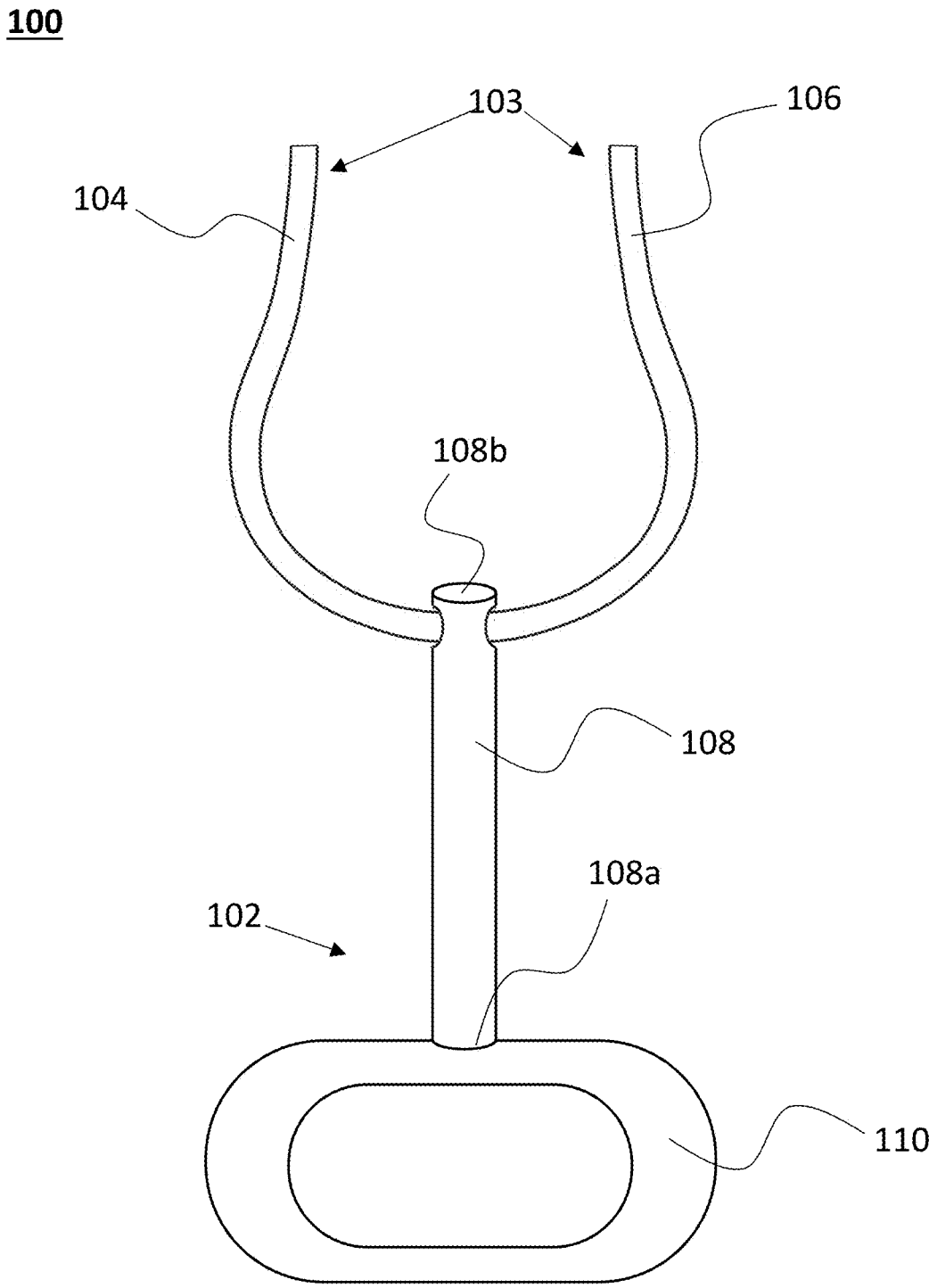
FIG. 1*b* illustrates an improved bath tool for cleaning a person's body with a handle which includes a rod and a hand grip, according to some embodiments of the present invention.
Figure 1C:
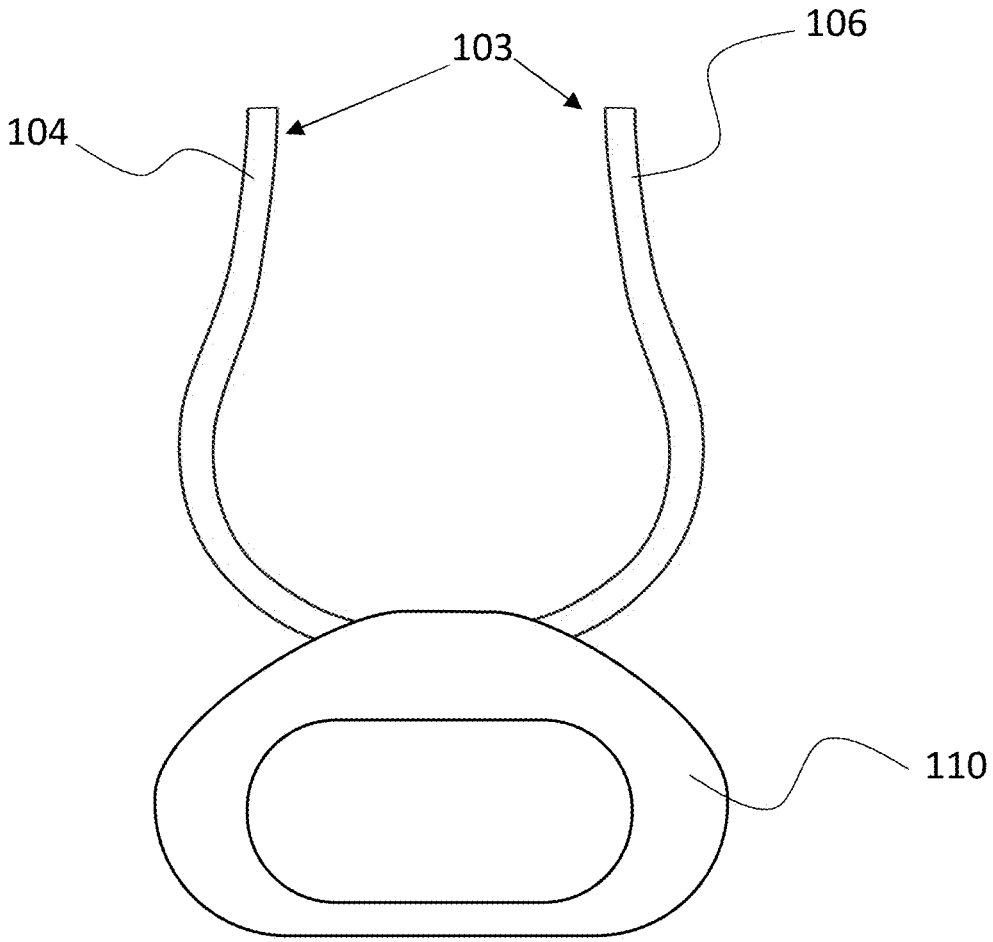
FIG. 1*c* illustrates an improved bath tool for cleaning a person's body with a handle which includes a hand grip, according to some embodiments of the present invention.
Figure 10:
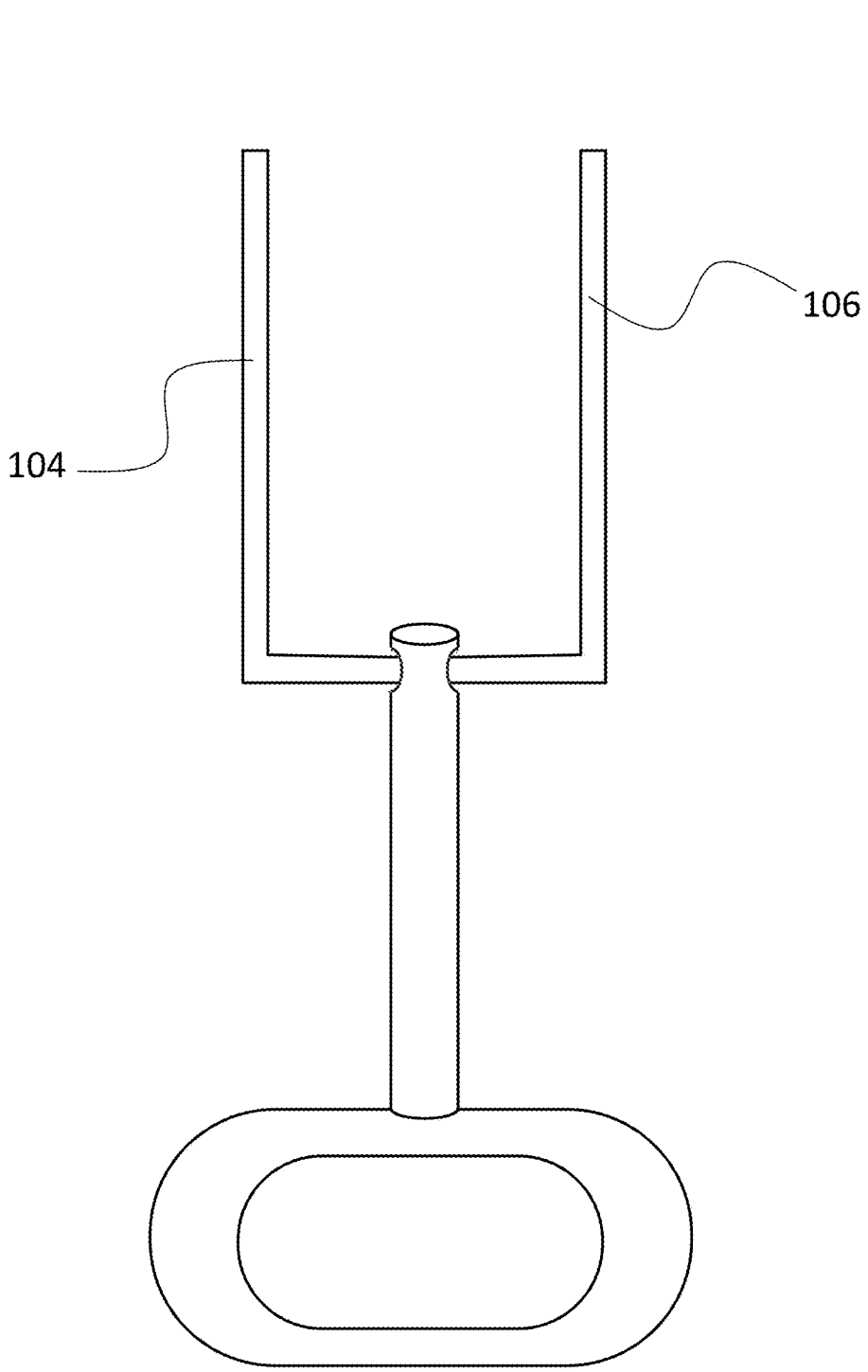
FIG. 10 illustrates an improved bath tool with U-shaped arms, according to some embodiments of the present invention.

In the examples of FIGS. 1*a*-1*c*, the frame 103 is an open loop which includes first arm 104 and second arm 106. The arms 104 and 106 are connected to one end of the handle, and joined to the same end of the handle. The arms 104 and 106 are biased toward each other. In a non-limiting example, the arms' bias cause the arms to form a U-shape, as seen in FIG. 10. The arms are designed to have cleaning elements disposed thereon, as will be seen further below.

Figure 1D:
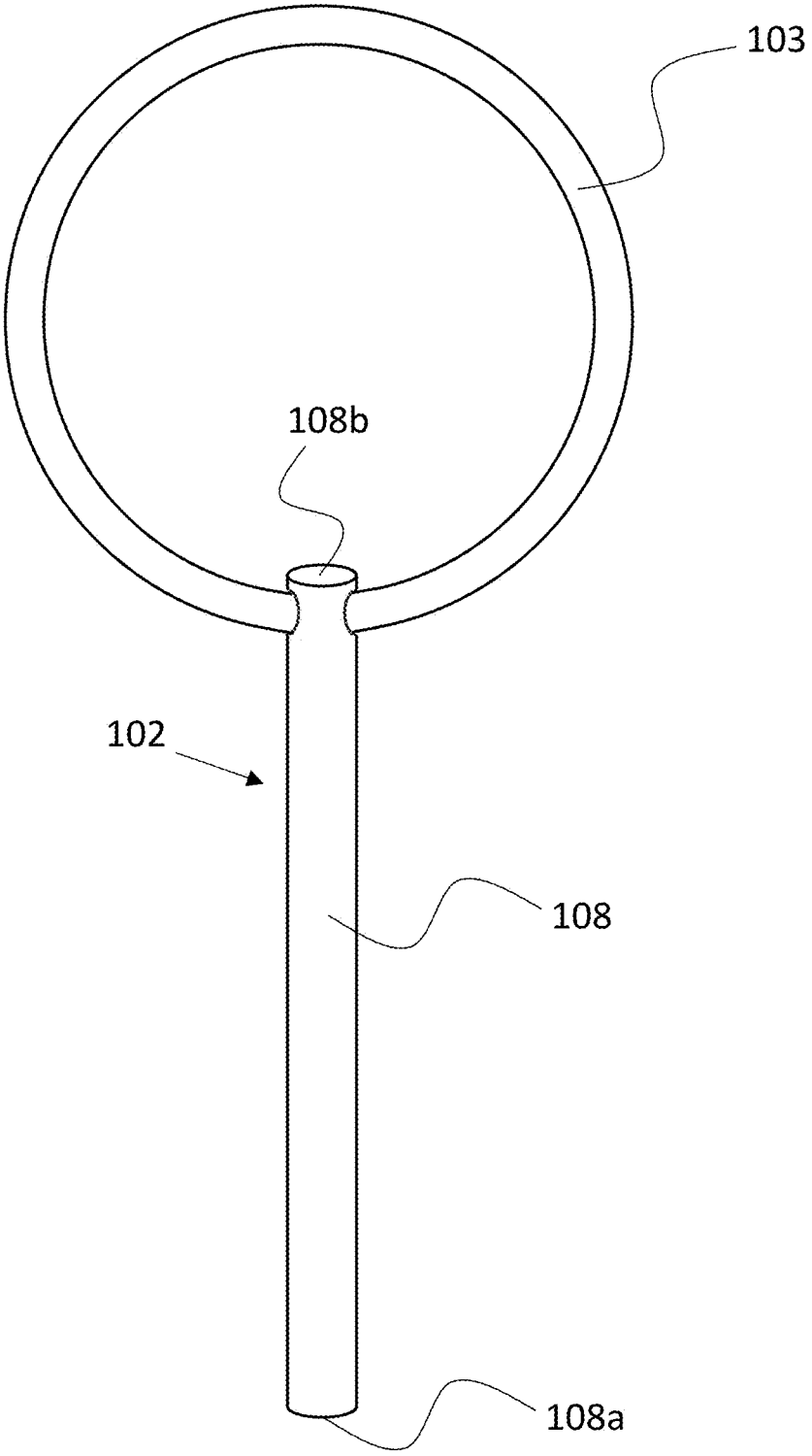
FIG. 1*d* illustrates an improved bath tool for cleaning a person's body in which the frame is shapes as a closed loop, according to some embodiments of the present invention.

In FIG. 1*d*, the frame 103 is in the form of a closed loop. The closed loop may be circular, as seen in the example of FIG. 1*d*, but may be polygonal, elliptical, or in any other closed shape.

In use, the user holds the handle 102 and scrubs the user's body with the cleaning elements on the frame 13. The open or closed loop of the frame 103 can partially or completely surround a user's body part, therefore contacting the body part simultaneously from a plurality of locations and enabling the user scrub most the body contacting the open or closed loop in a single, easy motion, as opposed to the requiring the user to scrub all around the body using many small motions if using a sponge, a brush, or the user's hand without the tool 100. It should be noted that the tool 100 may be used outside of the bath or shower as well. In a non-limiting example the tool 100 may include brush bristles disposed on the inner surface of the open and closed loops and may be used as hair brush or a brush for a pet.

In the embodiments in which the frame 103 includes arms 104 and 106, the arms may be flexible and elastic. In this manner, a limb may be inserted between the arms 104 and 106, and the arms open up in the areas where the limbs is thicker and close up to their rest state in areas where the limb this is thinner. Thus, the tool 100 configures itself according to the thickness of the body part surrounded by the arms.

In the example of FIG. 1*a*, the handle 102 comprises a rod 108 having a grip end 108*a* and a frame end 108*b*. The frame end 108*b* is joined to the frame 103. In use, the user's hand holds the rod 108 to guide the arms to scrub a desired part of the user's body. It should be noted that the configuration of the handle 102 of FIG. 1*a* can be applied to embodiments in which the frame is shaped as an open loop and a closed loop. In some embodiments of the present invention, the frame and the rod are integral with each other and produced from a single mold. In other embodiments of the present invention, the frame and the rod are produced separately and are removably or fixedly joined to each other after the molding.

In the example of FIG. 1*b*, the handle 102 comprises a hand grip 110 and a rod 108. The rod has a grip end 108*a* and a frame end 108*b*. The grip end 108*a* is joined to the hand grip 110. The frame end 108*b* is joined to the frame 103. The hand grip 110 is shaped for being comfortably held by a user's hand. In some embodiments of the present invention, the hand grip 110 is shaped as a loop having an aperture for insertion of the user's fingers, to enable a tight grip of the bath tool 100.

Figure 1E:
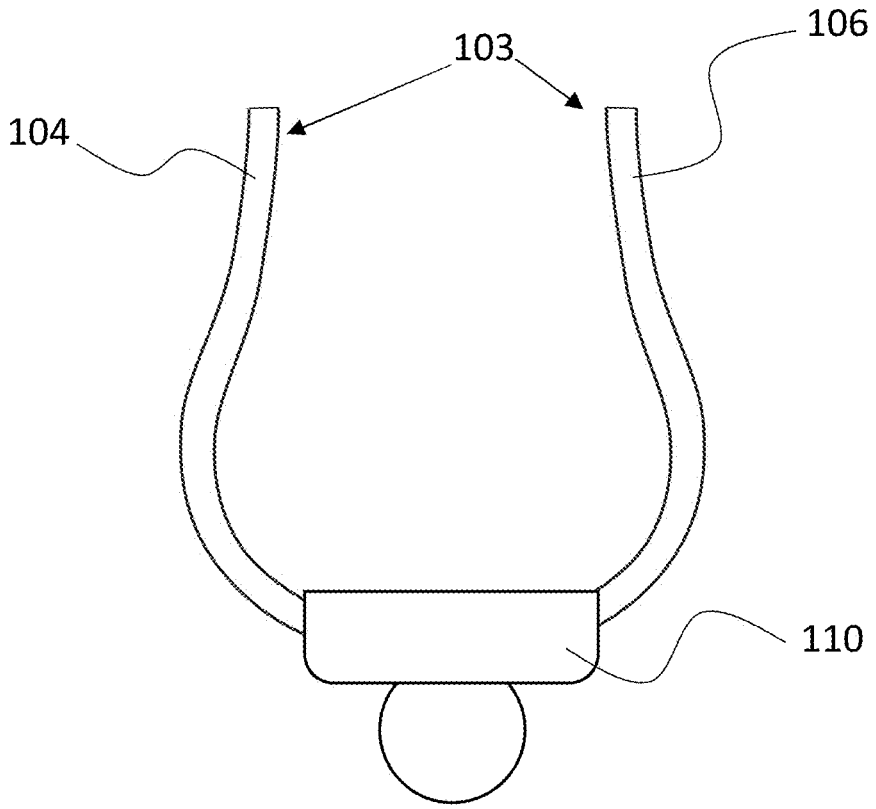
FIG. 1*e* illustrates an improved bath tool for cleaning a person's body in which the hand grip includes a knob, according to some embodiments of the present invention.
Figure 2:
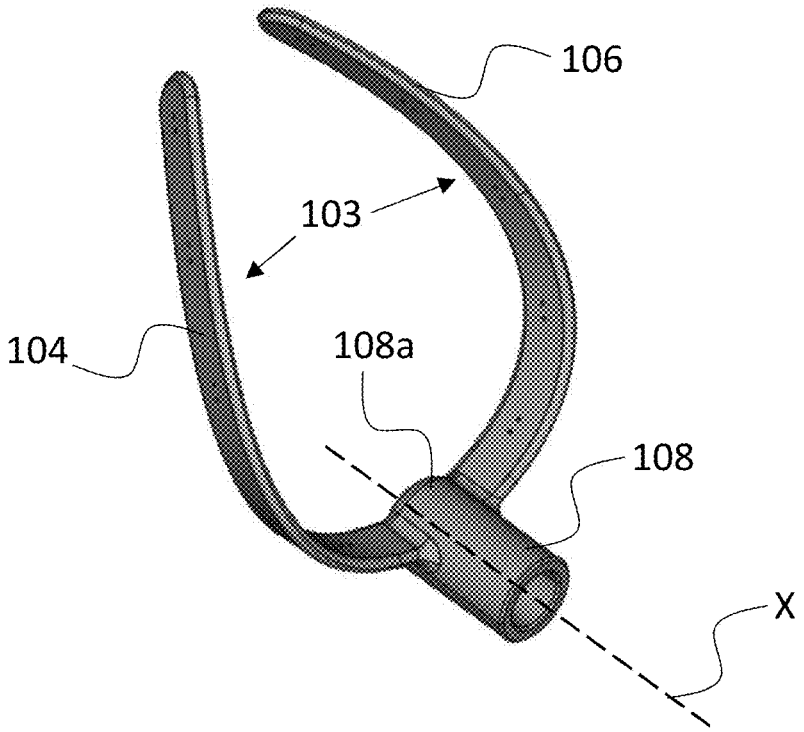
FIGS. 2-5 illustrate an example of an arm end of an improved bath tool, in which the arms extend upwards from a rod end.
Figure 3:
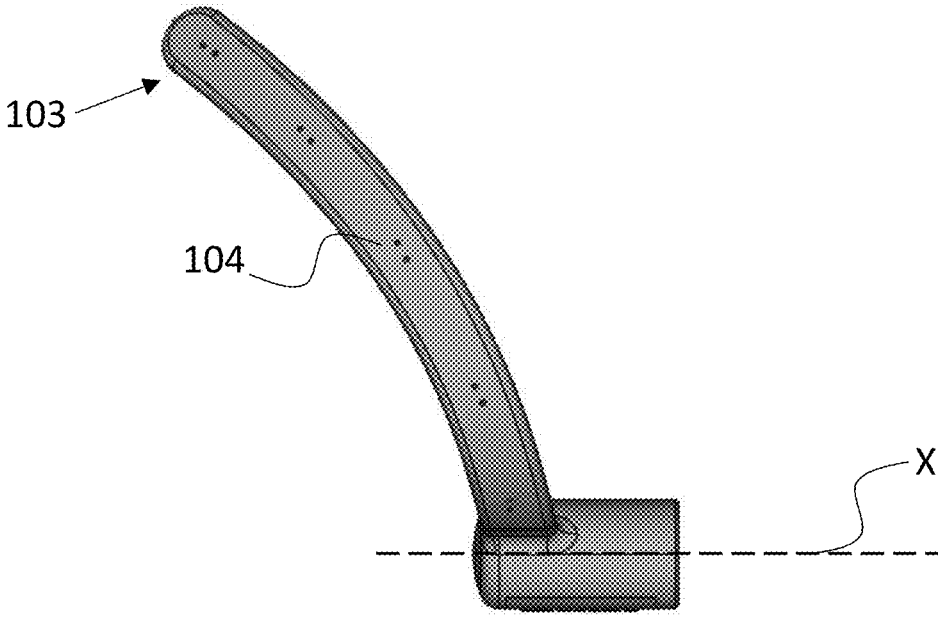
Figure 4:
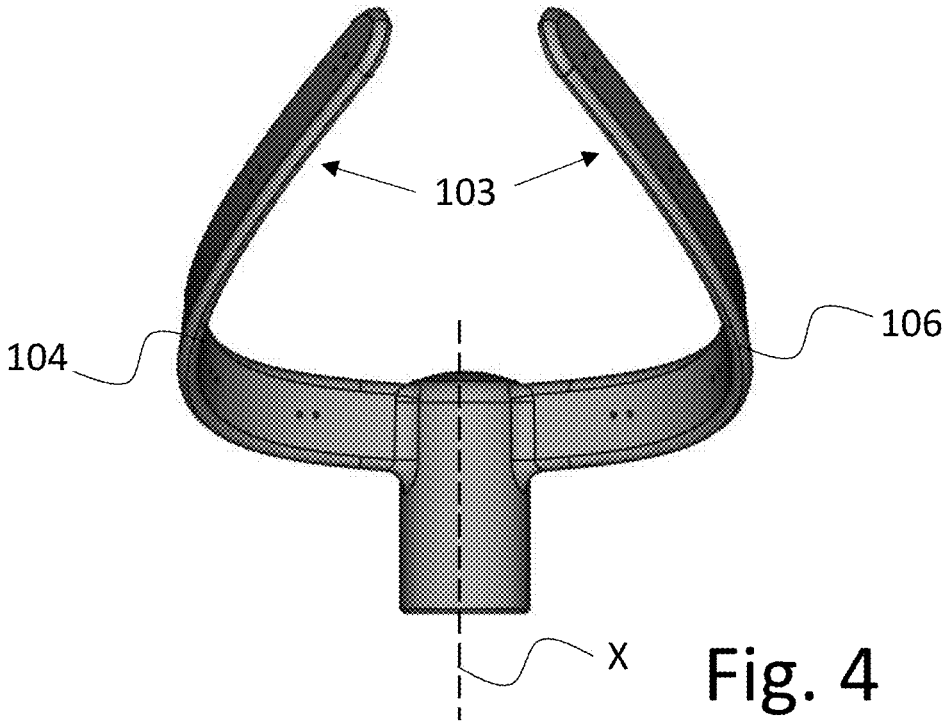
Figure 5:
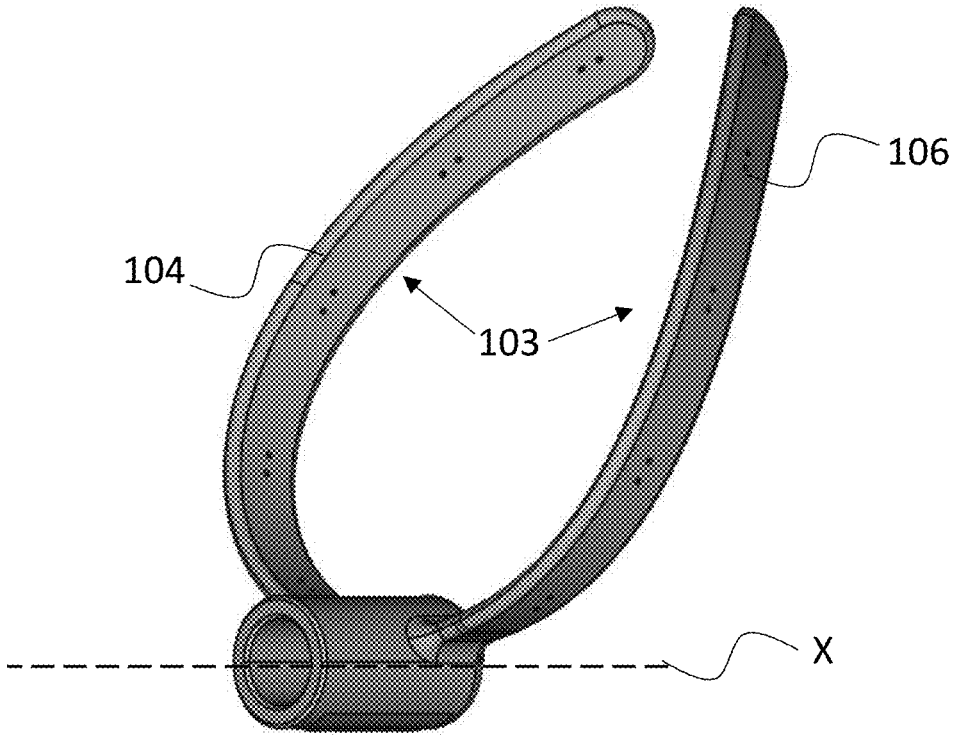

In the example of FIG. 1*c*, the handle 102 comprises a hand grip 110. The frame 103 (whether shaped as closed loop or as an open loop) is joined directly to the hand grip 110. In some embodiments of the present invention, the hang grip 110 is shaped as a loop having an aperture for insertion of the user's fingers, to enable a tight grip of the bath tool 100. In other embodiments of the present invention, the hand grip is in the form of a knob configured to be held, as shown in FIG. 1*e*. The knob may provide a comfortable hold if the tool 100 is used as a brush for pets (e.g., cats and dogs), with brush bristles covering the inner surfaces of the arms 104 and 106.

FIGS. 2-5 illustrate an example of an arm end of an improved bath tool, in which the frame 103 extends at an angle with the arm end 108*a* of the rod 108. While the examples of FIGS. 2-5 relate to the embodiments in which the frame is shaped like an open loop and includes arms 104 and 106, it is important to note that the features of FIGS. 2-5 also apply to a frame 103 shaped as closed loop.

The rod extends along a longitudinal axis X. Seen from the side, where the longitudinal axis X is horizontal, both arms 104 and 106 extend from the arm end 108*a* of the rod and above longitudinal axis. This enables the user to easily scrub a limb of the user, while holding the rod more or less parallel to the limb being scrubbed.

Figure 6:
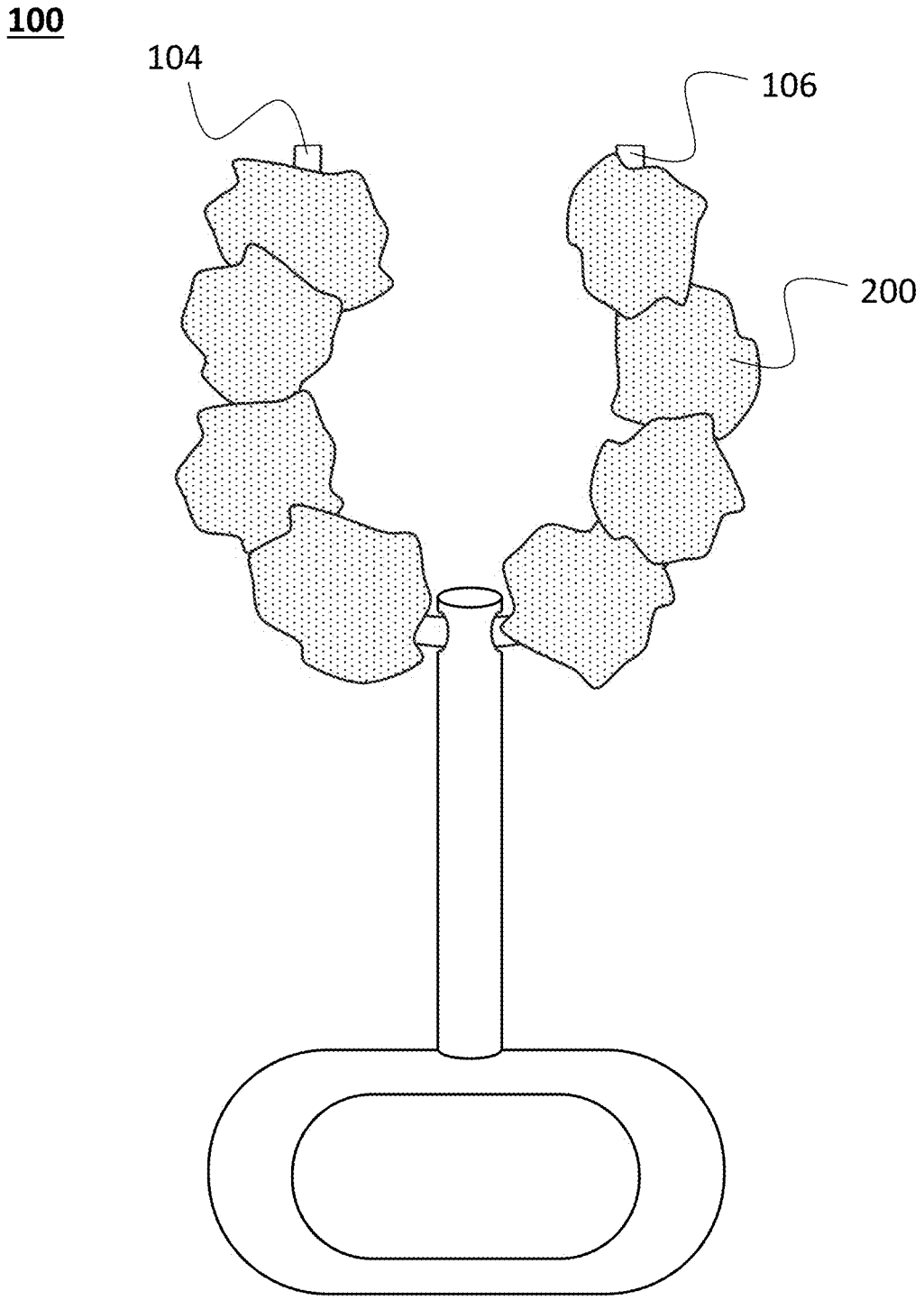
FIG. 6 illustrates an improved bath tool to which loofahs are joined, according to some embodiments of the present invention.
Figure 7:
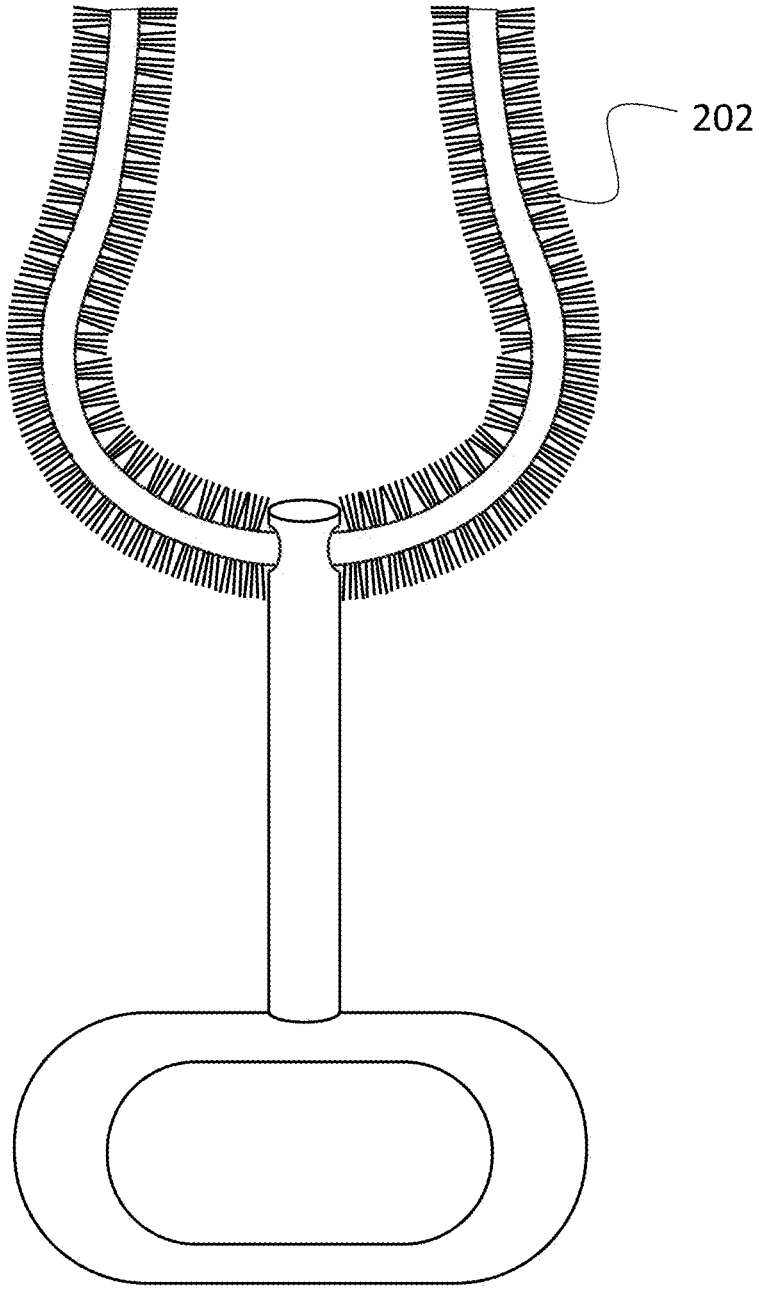
FIG. 7 illustrates an improved bath tool to which brush bristles are joined, according to some embodiments of the present invention.
Figure 8:
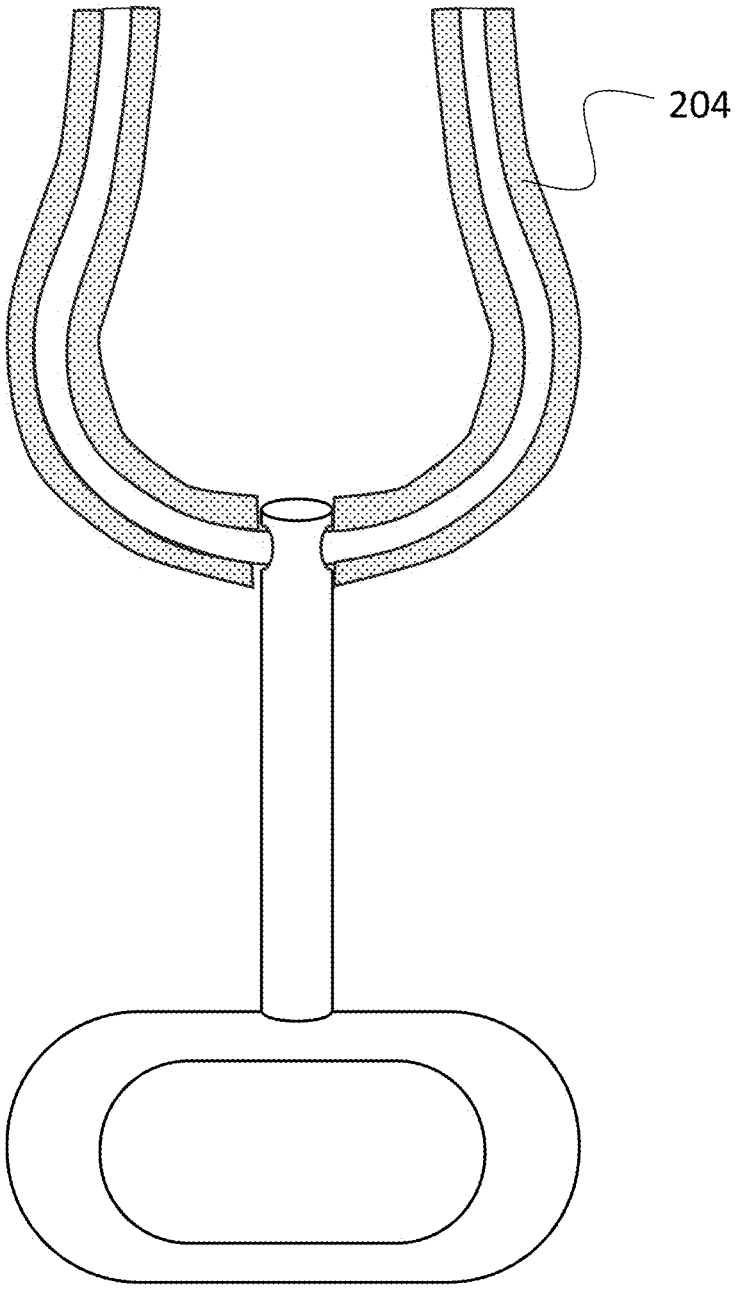
FIG. 8 illustrates an improved bath tool to which brush sponges are joined, according to some embodiments of the present invention.

FIG. 6 illustrates an improved bath tool to which natural or synthetic loofahs 200 are joined, according to some embodiments of the present invention. FIG. 7 illustrates an improved bath tool to which brush bristles 202 are joined, according to some embodiments of the present invention. FIG. 8 illustrates an improved bath tool to which sponges 204 are joined, according to some embodiments of the present invention. It should be noted that other types of cleaning elements may be used, and the scope of the present invention extends to any cleaning element that can be used to scrub the user's skin and is joinable (fixedly or removably) to the arms. While the examples of FIGS. 6-8 relate to the embodiments in which the frame is shaped like an open loop and includes arms 104 and 106, it is important to note that the features of FIGS. 2-5 also apply to a frame 103 shaped as closed loop.

In the frame 103 is in the form of arms 104 and 106, the loofahs 200 may be joined to the arms 104 and 106 simply by traversing the arms. In this manner, the loofahs may be removed from the bath tool 100 and replaced, if needed. Alternatively, the loofahs are fixedly joined to the arms. If the frame 103 is in the form of a closed loop, the loofahs may be joined to the frame prior to closing the loop during the fabrication of the tool 100.

The cleaning elements (e.g., loofahs 200, brush bristles 202, the sponges 204, or any other cleaning elements) may be joined to an inner surface of the frame (e.g., inner surfaces of the arms (i.e., the surfaces of each arm facing the other arm)), to cover the inner surface of the open or closed loop formed. If the frame 103 is an open loop, a cleaning surface is formed on each arm facing the other arm. In some embodiments of the present invention, cleaning elements (e.g., loofahs 200, brush bristles 202, the sponges 204, or any other cleaning elements) are also joined to outer surfaces of the frame (e.g., the surfaces of each arm facing away from the other arm), to cover the outer surface of the open or closed loop. if the frame 103 is an open loop a cleaning surface is also formed on each arm facing away the other arm. In some embodiments of the present invention, cleaning elements (e.g., loofahs 200, brush bristles 202, the sponges 204, or any other cleaning elements) cover most of all of the surface of the frame. In the case in which the frame is in the form of two arms, the cleaning elements on the first arm surround the first arm, while the cleaning elements on the second arm surround the second arm.

Figure 9:
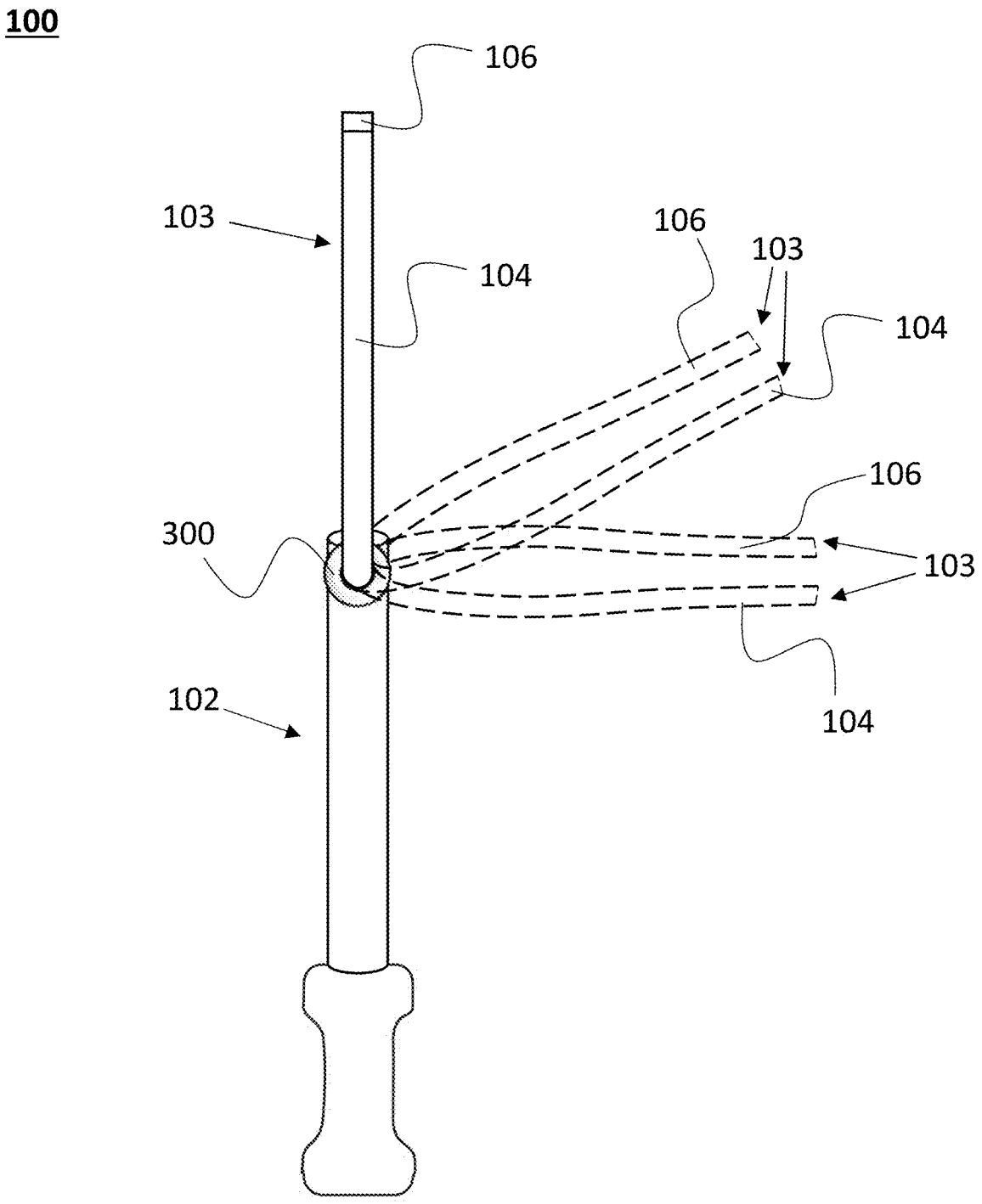
FIG. 9 illustrates an improved bath tool with rotatable arms, according to some embodiments of the present invention.

FIG. 9 illustrates an improved bath tool with a rotatable frame 103, according to some embodiments of the present invention.

The frame 103 may be hingedly joined to the handle 102, to enable rotation of the frame with respect to the handle 102. In some embodiments of the present invention, the bath tool 100 includes a locking mechanism 300 configured to retain the frame at a desired angle with the respect to the handle. Many such mechanisms are known in the general art, for changing and angle between two objects that are hingedly joined to each other. Many of these mechanisms may be applicable to the locking mechanism of the present invention. The scope of the present invention is not limited to any specific type of locking mechanism, and extends to any type of mechanism that enables a user to rotate the frame 103 with respect to the handle 102 and to selectively lock the frame 103 at a desired angle with respect to the handle 102 and release the frame from its locked position so the frame can be rotated again and locked in at a different angle with respect to the frame. In some embodiments of the present invention, the locking mechanism enables locking the frame at discrete predetermined angles. In other embodiments of the present invention, the locking mechanism enables locking the frame at any angle within a certain range of angles.

Figure 11:
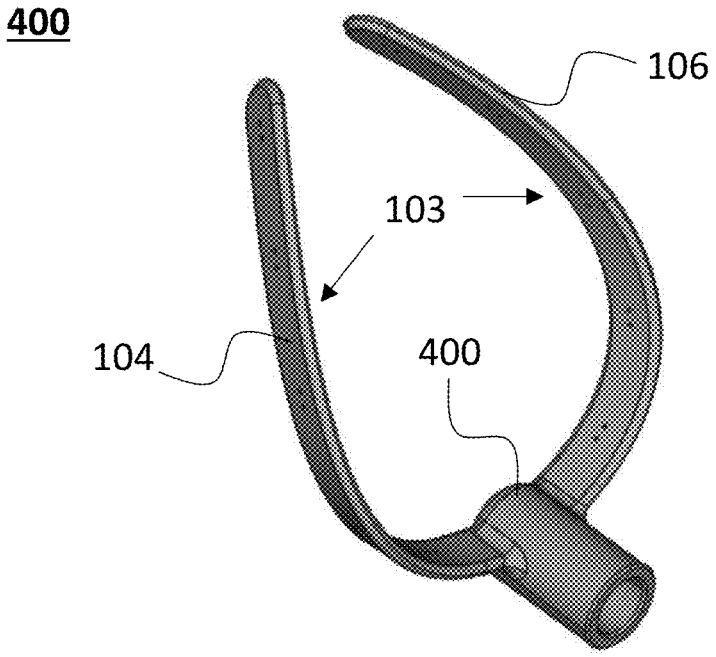
FIG. 11 illustrates a tool bath add-on 400 configured to be joined to a rod to form a tool bath.

FIG. 11 illustrates a tool bath add-on 400 configured to be joined to a rod to form the tool bath described above.

The add-on 400 incudes a sleeve 402 and a frame 103 (which may be shaped as a closed loop or may include arms 104 and 106 extending from the sleeve and biased toward each other). The sleeve is configured to be removably joined to a rod. The add-on 400 and the rod (not shown) form together a bath tool descried above in FIG. 1*a*. The sleeve may include threads that cooperate with threads on the end of the rod. The sleeve may be elastic and may fit on to the rod by being pressed against the end of the rod.

What is claimed is:

1. An improved bath tool for cleaning a person's body, comprising:

a handle;

a frame for holding cleaning elements, the frame comprising two arms connected to one end of the handle, joined to a same end of the handle, and the arms being biased toward each other, each of the arms having a respective inner surface and a respective outer surface, the inner surfaces facing each other and the outer surfaces facing away from each other;

cleaning elements disposed on at least the inner surfaces of the arms;

wherein the arms are sized to partially or completely surround a user's body part therebetween, such that the cleaning elements on the inner surfaces of the arms are configured to contact the body part simultaneously from a plurality of locations;

wherein the arms are elastic, the arms having a rest distance between each other for receiving the body part between the arms, such that the arms are pushed away from each other by the body part between the arms where the body part is thicker than the rest distance and close up to the rest distance where the body part is thinner than the rest distance;

the cleaning elements on the first arm surround the first arm;

the cleaning elements on the second arm surround the second arm.

2. The bath tool of claim 1, wherein the handle comprises a rod having a grip end and a frame end, the frame end being joined to the frame.

3. The bath tool of claim 1, wherein the handle comprises a hand grip and a rod, the rod having a grip end and a frame end, the grip end being joined to the hand grip and the frame end being joined to the frame;

wherein the hand grip is shaped as a loop having an aperture for insertion of the user's fingers, to enable grip of the bath tool.

4. The bath tool of claim 1, wherein the cleaning elements comprise at least one of the following:

brush bristles;

one or more sponges;

natural and/or synthetic loofahs.

5. The bath tool of claim 1, wherein the cleaning elements form a first cleaning surface on the inner surface of the frame.

6. The bath tool of claim 5, wherein the cleaning elements further form a second cleaning surface on an outer surface of the frame.

7. The bath tool of claim 1, wherein:

the cleaning elements on the first arm form a first cleaning surface facing the second arm;

the cleaning elements on the second arm form a second cleaning surface facing the first arm.

8. The bath tool of claim 7, wherein:

the cleaning elements on the first arm further form a third cleaning surface facing away from the second arm;

the cleaning elements on the second arm further form a fourth cleaning surface facing away from the first arm.

9. The bath tool of claim 1, wherein the arms together form a U-shape.

10. The bath tool of claim 1, wherein the arms are integral with each other.

11. The bath tool of claim 1, wherein the frame is hingedly joined to the handle.

12. The bath tool of claim 11, comprises a locking mechanism configured to be removably lock the frame at a desired angle with the respect to the handle.

13. The bath tool of claim 1, wherein a distance between wherein:

the two arms have proximal ends and distal ends, the proximal ends of the arms being connected to one end of the handle and joined to the same end of the handle, the arms being biased toward each other, such that the distal ends of the arms are not joined to each other;

the arms are curved, such that a maximal distance between the arms is larger than a distance between the distal ends of the arms in an equilibrium configuration of the arms, when no force is applied to either one of the arms.

14. The bath tool of claim 13, wherein the distance between the distal ends of the arms is one third or less of the maximal distance between the arms, in the equilibrium configuration of the arms.

15. An add-on to a handle rod for being gripped, the add-on being configured to form an improved bath tool for cleaning a person's body, the add-on comprising:

a sleeve configured to removably fit onto an end segment of a handle rod extending away from the sleeve;

a frame joined to the sleeve and configured for holding cleaning elements, the frame being shaped as an open or closed loop;

wherein the frame is configured to have cleaning elements joined to at least an inner surface of the open or closed loop;

wherein the open or closed loop is sized to partially or completely surround a user's body part, such that the cleaning elements on an inner surface of the open or closed loop are configured to contact the body part simultaneously from a plurality of locations.

16. The add-on of claim 15, wherein:

is shaped as an open loop and comprises two arms connected to one end of the sleeve, joined to a same end of the sleeve, and the arms being biased toward each other, each of the arms having a respective inner surface and a respective outer surface, the inner surfaces facing each other and the outer surfaces facing away from each other;

the frame is configured to have cleaning elements joined to at least inner surfaces of the arm;

the arms are elastic, the arms having a rest distance between each other for receiving the body part between the arms, such that the arms are pushed away from each other by the body part between the arms where the body part is thicker than the rest distance and close up to the rest distance where the body part is thinner than the rest distance.

17. An improved bath tool for cleaning a person's body, comprising:

a handle;

a frame for holding cleaning elements, the frame comprising two arms connected to one end of the handle, joined to a same end of the handle, and the arms being biased toward each other, each of the arms having a respective inner surface and a respective outer surface, the inner surfaces facing each other and the outer surfaces facing away from each other;

cleaning elements disposed on at least the inner surfaces of the arms;

wherein the arms are sized to partially or completely surround a user's body part therebetween, such that the cleaning elements on the inner surfaces of the arms are configured to contact the body part simultaneously from a plurality of locations;

wherein the arms are elastic, the arms having a rest distance between each other for receiving the body part between the arms, such that the arms are pushed away from each other by the body part between the arms where the body part is thicker than the rest distance and close up to the rest distance where the body part is thinner than the rest distance;

wherein the handle comprises a hand grip and a rod, the rod having a grip end and a frame end, the grip end being joined to the hand grip and the frame end being joined to the frame;

wherein the hand grip is shaped as a loop having an aperture for insertion of the user's fingers, to enable grip of the bath tool.

18. An improved bath tool for cleaning a person's body, comprising:

a handle;

a frame for holding cleaning elements, the frame comprising two arms connected to one end of the handle, joined to a same end of the handle, and the arms being biased toward each other, each of the arms having a respective inner surface and a respective outer surface, the inner surfaces facing each other and the outer surfaces facing away from each other;

cleaning elements disposed on at least the inner surfaces of the arms;

wherein the arms are sized to partially or completely surround a user's body part therebetween, such that the cleaning elements on the inner surfaces of the arms are configured to contact the body part simultaneously from a plurality of locations;

wherein the arms are elastic, the arms having a rest distance between each other for receiving the body part between the arms, such that the arms are pushed away from each other by the body part between the arms where the body part is thicker than the rest distance and close up to the rest distance where the body part is thinner than the rest distance;

wherein the frame is hingedly joined to the handle;

wherein the bath tool comprises a locking mechanism configured to be removably lock the frame at a desired angle with the respect to the handle.

19. An improved bath tool for cleaning a person's body, comprising:

a handle;

a frame for holding cleaning elements, the frame comprising two arms connected to one end of the handle, joined to a same end of the handle, and the arms being biased toward each other, each of the arms having a respective inner surface and a respective outer surface, the inner surfaces facing each other and the outer surfaces facing away from each other;

cleaning elements disposed on at least the inner surfaces of the arms;

wherein the arms are sized to partially or completely surround a user's body part therebetween, such that the cleaning elements on the inner surfaces of the arms are configured to contact the body part simultaneously from a plurality of locations;

wherein the arms are elastic, the arms having a rest distance between each other for receiving the body part between the arms, such that the arms are pushed away from each other by the body part between the arms where the body part is thicker than the rest distance and close up to the rest distance where the body part is thinner than the rest distance;

wherein the two arms have proximal ends and distal ends, the proximal ends of the arms being connected to one end of the handle and joined to the same end of the handle, the arms being biased toward each other, such that the distal ends of the arms are not joined to each other;

wherein the arms are curved, such that a maximal distance between the arms is larger than a distance between the distal ends of the arms in an equilibrium configuration of the arms, when no force is applied to either one of the arms.

* * * * *